United States Patent [19]

Kasai

[11] Patent Number: 4,578,966

[45] Date of Patent: Apr. 1, 1986

[54] DOUBLE SLIDER LOCKING SLIDE FASTENER

[75] Inventor: Kazumi Kasai, Namerikawa, Japan

[73] Assignee: Yoshida Kogyo K. K., Tokyo, Japan

[21] Appl. No.: 400,042

[22] Filed: Jul. 20, 1982

[30] Foreign Application Priority Data

Jul. 25, 1981 [JP] Japan ..... 56-115891

[51] Int. Cl.[4] ..... E05B 69/00

[52] U.S. Cl. ..... 70/68; 24/418

[58] Field of Search ..... 70/68, 67, 64; 24/418

[56] References Cited

U.S. PATENT DOCUMENTS

| | | | |
|---|---|---|---|
| 1,285,848 | 11/1918 | Waing | 70/64 |
| 2,578,035 | 12/1951 | Bashover | 70/68 |
| 3,335,586 | 8/1967 | Levine et al. | 70/68 |
| 4,081,882 | 4/1978 | Toepelt et al. | 70/68 |
| 4,244,086 | 1/1981 | Gregg | 70/68 X |
| 4,271,689 | 6/1981 | Kasai | 70/68 |

FOREIGN PATENT DOCUMENTS

| | | | |
|---|---|---|---|
| 536707 | 5/1922 | France | 70/67 |
| 507616 | 12/1954 | Italy | 70/67 |
| 629783 | 12/1961 | Italy | 70/68 |
| 413825 | 7/1934 | United Kingdom | 70/68 |

*Primary Examiner*—Kenneth J. Dorner
*Assistant Examiner*—Lloyd A. Gall
*Attorney, Agent, or Firm*—Hill, Van Santen, Steadman & Simpson

[57] ABSTRACT

A first pull tab of one slider is selectively positionable onto a second pull tab of a second slider with a U-shaped projection of said second slider extending through an aperture in the first pull tab, when the two sliders are located in juxtaposition. A locking device is mounted on the first pull tab and includes a bolt lockingly engageable with a recess in the projection of said second slider.

4 Claims, 10 Drawing Figures

DOUBLE SLIDER LOCKING SLIDE FASTENER

BACKGROUND OF THE INVENTION

1. Field of the Invention:

The present invention relates to slide fasteners of the type having two sliders which act independently of one another for opening and closing a common slide fastener and which can be locked together against movement away from each other in their fully closed position on the slide fastener.

2. Prior Art:

Double slider slide fasteners are well known, wherein two sliders act independently of one another, and can be drawn together to effect the full closure of the slide fastener. For example, slide fasteners of this type have been employed frequently as a closure member for suitcases, garment bags or other similar luggage items.

In such use, it is frequently desirable to be able to lock the slide fasteners, and for this purpose, each of the sliders has an upstanding projection with a hole extending transversely therethrough. Two of such sliders may be locked together by a padlock having a shackle extending through the holes in the projections. The padlockable slide fasteners are defective from an aesthetic view, and are tedious in locking and unlocking operation.

Another known double slider locking slide fastener comprises one slider including a socket portion and the other slider having a plug portion fittable in the socket portion. The one slider includes a locking mechanism built in the slider body and having a locking member lockingly engageable with the socket portion of the other slider. The locking mechanism is complex in structure, making the slider body bulky and giving it a relatively high profile.

SUMMARY OF THE INVENTION

A double slider locking slide fastener comprises a pair of sliders movable independently of one another for opening and closing a common slide fastener. Each of the sliders includes a U-shaped projection and a pull tab pivotably connected to the projection. One slider has in its pull tab an aperture for receipt onto the projection of the other slider at one position. The other slider has in its projection a recess opening outwardly of the aperture when the pull tab of said one slider is in said one position. A locking device comprises a housing disposed on said one slider's pull tab, a driver movably received in the housing, and a bolt connected to the driver in driven relation thereto and movable, in response to the movement of said driver, between a first position in which the bolt partly projects inwardly of said aperture and a second position in which the bolt is held outside of said aperture. The bolt has a portion engageable with the recess when it is in the first position with said one slider's pull tab in said one position.

It is an object of the present invention to provide a double slider locking slide fastener including a pair of interlockable sliders which is simple in construction and reliable in operation, and has a relatively low profile.

Another object of the present invention is to provide a double slider locking slide fastener including a simple locking device disposed on a pull tab of one slider.

Many other advantages, features and additional objects of the present invention will become manifest to those versed in the art upon making reference to the detailed description and the accompanying drawings in which two preferred embodiments incorporating the principles of the present invention are shown by way of illustrative example.

BRIEF DESCRIPTION OF THE DRAWINGS

FIGS. 11 and 12 are views similar to FIGS. 1 and 2, respectively, but showing a modification of the present invention.

DETAILED DESCRIPTION

Figure 1:
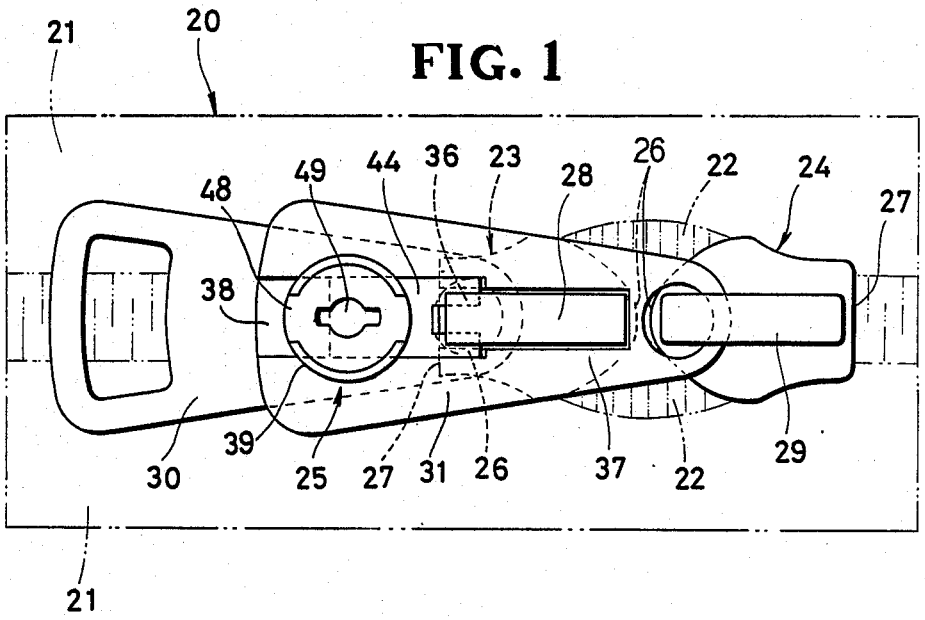
FIG. 1 is a plan view of a portion of a double slider locking slide fastener in accordance with the present invention, the locking slide fastener having two sliders locked together.
Figure 2:
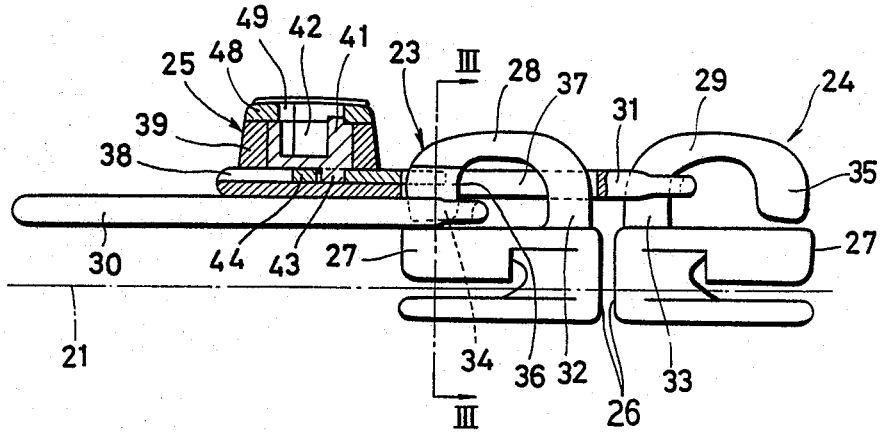
FIG. 2 is a side elevational view, partly in cross section, of the double slider locking slide fastener of FIG. 1.

The principles of the present invention are particularly useful when embodied in a double slider locking slide fastener such as shown in FIGS. 1 and 2, generally indicated by the numeral 20.

The double slider locking slide fastener 20 (hereinafter referred to as "locking slide fastener") includes a pair of conventional slide fastener stringer tapes 21,21 arranged in side by side relationship and a pair of rows of coupling elements or scoops 22,22 mounted on and along inner longitudinal edges of the stringer tapes 21,21, respectively. A pair of sliders 23,24 is mounted on the locking slide fastener 20 to slide along the scoops 22,22 such that the scoops 22,22 of the adjacent tapes 21,21 are interlocked on the sides of each slider 23,24 away from the other slider 24,23, while the scoops 22,22 between the two sliders 23,24 are not interlocked and form an opening between the sliders 23,24. In FIGS. 1 and 2, the sliders 23 and 24 are shown joined together against movement relative to each other by a locking device 25 described hereinbelow.

The internal configuration of the sliders 23,24, for effecting the closing and opening of the locking slide fastener 20, is conventional, and hence need not be considered in detail in this disclosure. It will merely be noted that the sliders 23,24 have ends 26,26, which are herein arbitrarily designated as leading ends, directed toward the opening or non-interlocked scoops, and ends 27,27 herein designated as trailing ends directed toward the adjacent interlocked scoops.

As seen in FIGS. 1, 2, 3, 5, 7 and 8, each of the sliders 23,24 is provided with a U-shaped projection 28,29 extending lengthwise of the slide fastener 20 and a pull tab 30,31 pivotably connected to the projection 28,29. The projection 28,29 is in the form of a loop or an inverted U-shaped element having one arm 32,33 (FIGS. 2, 5 and 8) joined with the base of the slider 23,24, at the leading end 26,26 thereof. The other arm 34,35 (FIGS. 2, 5 and 8) may be spaced from (as in the illustrated embodiment) or contact the base of the slider 23,24 at the trailing end 27,27 thereof, but, if there is a gap, the gap is of inadequate width for the pull tab 30,31 to pass therethrough. Each of the pull tabs 30,31 may be rotated in a vertical plane to the locking slide fastener 20, from a first position lying on the slider 23,24 to a second position 180 degrees therefrom. The pull tabs 30,31 are used in the normal way to enable pulling of the sliders 23,24 along the scoops 22,22 to a desired location.

Figure 4:
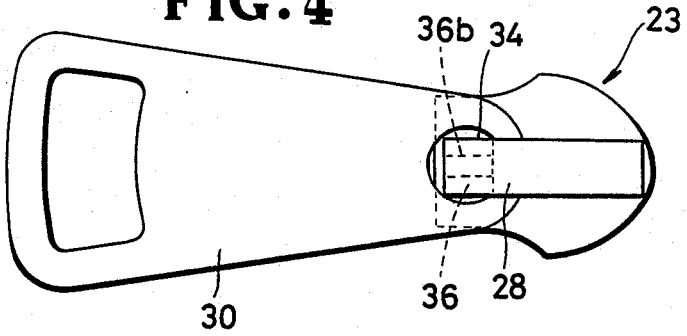
FIG. 4 is a plan view of one slider of the double slider locking slide fastener of FIG. 1.
Figure 5:
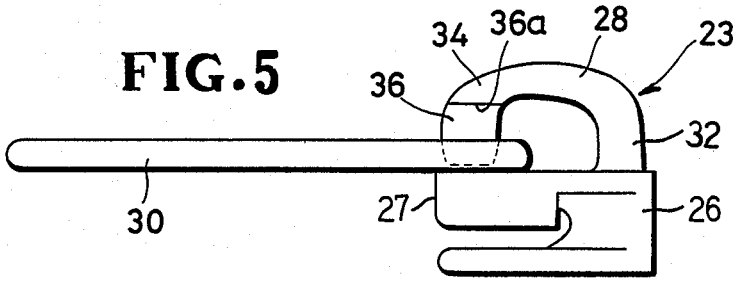
FIG. 5 is a side elevational view of the slider of FIG. 4.
Figure 6:
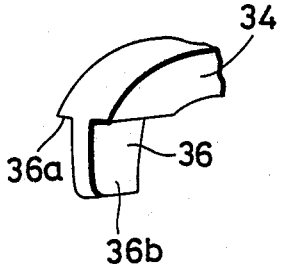
FIG. 6 is an enlarged view of a portion of a U-shaped projection of the slider of FIG. 5.

As shown in FIGS. 4–6, the slider 23 has in its one or rear arm 34 of the U-shaped projection 28 a pair of lateral recesses 36,36 which also open in the direction of slider movement for the purposes described below. Each of the recesses 36,36 is defined by a horizontal wall 36*a* (FIGS. 5 and 6) extending parallel to the base of the slider 23 and a vertical wall 36*b* (FIGS. 4 and 6) extending normal to the slider's base.

Figure 7:
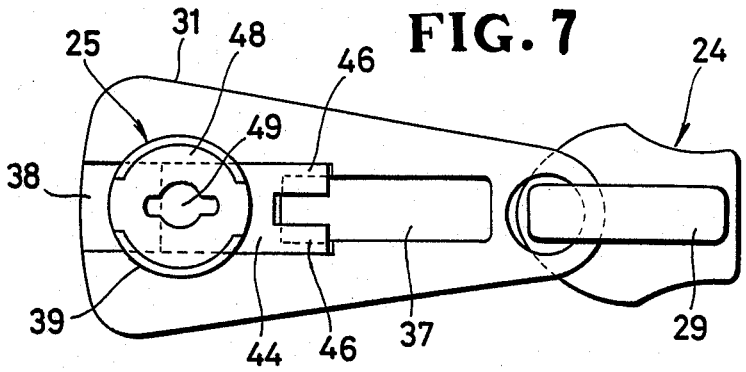
FIG. 7 is a plan view of the other slider of the double slider locking slide fastener of FIG. 1, the slider being provided with a locking device.
Figure 8:
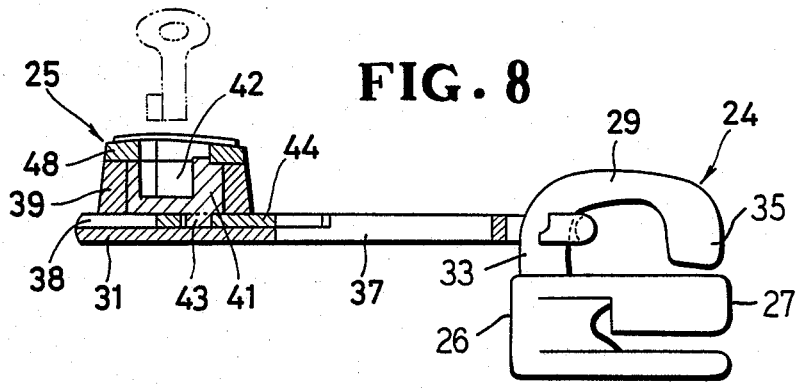
FIG. 8 is a side elevational view, partly in cross section, of the slider of FIG. 7.

As shown in FIGS. 7 and 8, the pull tab 31 of the slider 24 has an elongated aperture 37 complementary in contour to the projection 28 of the slider 23 for receipt onto the projection 28 at the second position thereof. The pull tab 31 further has a guide groove 38 extending longitudinally between the aperture 37 and the distal end of the pull tab 31, the guide groove 38 opening away from the base of the slider 24 when the pull tab 31 is in the second position shown in FIGS. 1, 2, 7 and 8.

Figure 9:
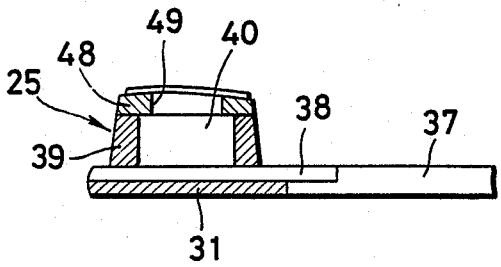
FIG. 9 is a cross-sectional view of the locking device of FIG. 8 with movable members being omitted for the purpose of explanation.
Figure 10:
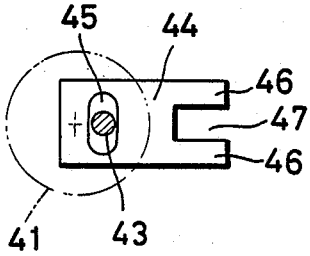
FIG. 10 is an enlarged plan view, partly in cross section, of the movable members of the locking device of FIG. 8.

The locking device 25 comprises an annular housing 39 formed integrally or otherwise joined with the pull tab 31 across the guide groove 38. The housing 39 has a cylindrical bore 40 (FIG. 9) extending longitudinally therethrough and communicating at one end with the guide groove 38. A driving member in the shape of a cylinder 41 is rotatably mounted within the bore 40 and has a slotted opening or key recess 42 into which the operative tip of a separate key (illustrated by the phantom lines in FIG. 8) is receivable for the rotation of the cylinder 41 thereby. The cylinder 41 has an axial pin 43 located on the lower surface thereof eccentric to the axis of the cylinder 41 and projecting axially downwardly into the guide groove 38 in the pull tab 31. The locking device 25 further includes a locking member or bolt 44 slidably received in the guide groove 38 and operatively coupled at one end with the cylinder 41. As shown in FIG. 10, the bolt 44 has at the one end an oblong opening 45 extending widthwise thereof and at the other end a pair of spaced locking portions 46,46 defining therebetween a space 47 for receiving therein the recessed rear arm 34 of the projection 28 of the slider 23. The oblong opening 45 loosely receives the axial pin 43 of the cylinder so that the bolt 44 slides in and along the guide groove 38 between a first position in which the locking portions 46,46 project into the recesses 36,36 and a second position in which the locking portions 46,46 are retracted from the recesses 36,36, in response to the rotary movement of the cylinder 41. A cover 48 is mounted on the housing 39 to hold the cylinder 41 rotatably within the bore 40. The cover 48 has a key hole 49 through which the key (FIG. 8) is inserted to actuate the locking device 25.

Figure 3:
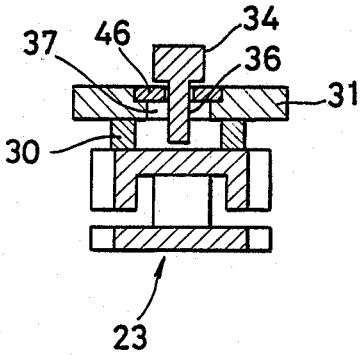
FIG. 3 is a cross-sectional view taken along the line III—III of FIG. 2.

In operation, the locking slide fastener 20 of the foregoing construction can be closed by moving either of the sliders 23,24 toward the other, or by moving both sliders 23,24 toward each other, until the sliders 23,24 are held in closed juxtaposition at their leading ends 26,26. When this is accomplished, the locking device 25 is actuated to place the bolt 44 in the second or retracted position. Then, the pull tab 31 of the slider 24 is rotated over and onto the pull tab 30 of the slider 23 with the projection 28 passing through the elongated aperture 37. In this position, the recesses 36,36 in the arm 34 open outwardly of the aperture 37 toward the locking portions 46,46 of the bolt 44 and also open in the direction of slider movement for having received such locking portions. The key is inserted through the key hole 49 into the key recess 42 in the cylinder 41. Rotation of the cylinder 41 causes the bolt 44 to slide in and along the guide groove 38 toward the recessed arm 34 whereupon the locking portions 46,46 are received into the recesses 36,36 in the arm 34. Thus, the sliders 23,24 are locked together against movement with respect to each other, as shown in FIGS. 1–3.

Advantages accruing from the arrangement of the present invention are as follows: No separate locking unit such as a padlock is required as the slider 24 has a locking device 25 on its pull tab 31. The locking device 25 comprises of a small number of components, and hence is simple in structure and reliable in operation. With the locking device 25 disposed on the pull tab 31 instead of in the slider body, the slider 24 has a relatively low profile.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A lockable pair of slide fastener sliders, comprising:

(a) a pair of sliders movable independently of one another for opening and closing a common slide fastener, each of said sliders including a U-shaped projection and a pull tab pivotably connected to said projection, said pull tab of one of said sliders having an aperture receptive of said U-shaped projection of the other slider in one pull tab position, and said U-shaped projection of said other slider having an arm with a pair of laterally spaced lateral recesses defining a T-shaped arm portion facing in a direction of slider movement; and (b) a locking device comprising a housing disposed on said pull tab of said one slider, a key-operated driver rotatably received in said housing, and a generally rectangular flat bolt having a pair of parallel spaced locking portions at one end and being connected to said driver at the opposite end in driven relation thereto and linearly reciprocable in response to rotational movements of said driver, between a first driver position in which said locking portions project in the direction of slider movement into said lateral recesses in said other slider arm and a second driver position in which said locking portions are held outside of said lateral recesses, said bolt receiving said T-shaped arm portion between its parallel spaced locking portions when said driver is in said first driver position with said pull tab of said one slider in said one pull tab position.

2. A lockable pair of slide fastener sliders according to claim 1, said pull tab of said one slider having a guide groove communicating at one end with said pull tab aperture, said bolt being slidably received in said guide groove.

3. A lockable pair of slide fastener sliders according to claim 1, said driver comprising a cylinder rotatably mounted in said housing and having an eccentric pin extending axially downwardly from the lower surface of said cylinder, said bolt comprising a linearly moveable rectangular plate having an oblong opening extending widthwise thereof, said eccentric pin being loosely and drivingly, received in said oblong opening.

4. A lockable pair of slide fastener sliders according to claim 1, said arm being disposed adjacent to the end of said other slider which is the more remote from said one slider.

* * * * *